US009828201B2

(12) United States Patent
Malmqvist et al.

(10) Patent No.: US 9,828,201 B2
(45) Date of Patent: Nov. 28, 2017

(54) REEL-UP FOR RECEIVING AND WINDING INTO A ROLL A PAPER WEB THAT ARRIVES FROM A DRYING CYLINDER IN A PAPER MAKING MACHINE AND A PAPER MAKING MACHINE USING A REEL-UP

(71) Applicant: Valmet Aktiebolag, Sundsvall (SE)

(72) Inventors: Per-Olof Malmqvist, Karlstad (SE); Massimiliano Candutti, Karlstad (SE); Tomas Carlsson, Hammaroe (SE)

(73) Assignee: VALMET AKTIEBOLAG, Sundsvall (SE)

( * ) Notice: Subject to any disclaimer, the term of this patent is extended or adjusted under 35 U.S.C. 154(b) by 64 days.

(21) Appl. No.: 15/031,603

(22) PCT Filed: Nov. 21, 2014

(86) PCT No.: PCT/SE2014/051395
§ 371 (c)(1),
(2) Date: Apr. 22, 2016

(87) PCT Pub. No.: WO2015/105444
PCT Pub. Date: Jul. 16, 2015

(65) Prior Publication Data

US 2016/0251187 A1 Sep. 1, 2016

(30) Foreign Application Priority Data

Jan. 9, 2014 (SE) ..... 1450011

(51) Int. Cl.
*B65H 20/06* (2006.01)
*B65H 18/22* (2006.01)
(Continued)

(52) U.S. Cl.
CPC ..... *B65H 18/22* (2013.01); *B08B 5/04* (2013.01); *B65H 20/06* (2013.01); *B65H 23/24* (2013.01);
(Continued)

(58) Field of Classification Search
CPC .... B65H 20/06; B65H 18/22; B65H 2801/84; B65H 2301/44336; B65H 2406/3124; B65H 2301/44322
(Continued)

(56) References Cited

U.S. PATENT DOCUMENTS 5,064,503 A 11/1991 Tavi
5,901,918 A 5/1999 Klerelid et al.
(Continued)

FOREIGN PATENT DOCUMENTS

CN 1046951 A 11/1990
CN 1047715 A 12/1990
(Continued)

OTHER PUBLICATIONS

State Intellectual Property Office of the P.R.C., Second Office Action for Application No. 201480061672.1, dated Mar. 23, 2017, 17 pages, China.
(Continued)

*Primary Examiner* — Mark Halpern
(74) *Attorney, Agent, or Firm* — Alston & Bird LLP

(57) ABSTRACT

The invention relates to a reel-up (1) for receiving and winding into a roll (5) a paper web (W) that arrives from a drying cylinder (2) in a paper making machine. The reel-up (1) comprises a rotatably mounted reel spool (4) onto which a paper web (W) can be wound to create a paper roll (5) of increasing diameter and an endless flexible belt (6) mounted for rotation along a predetermined path of travel such that the flexible belt (6) forms a loop. The flexible belt (6) is
(Continued)

positioned adjacent to the reel spool (4) to engage the paper web (W) against the reel spool (4) during winding such that the flexible belt (6) is deflected from the predetermined path of travel when the paper roll (5) starts to build up on the reel spool (4). The flexible belt (6) is air permeable and at least one blow box (7, 8, 9) is arranged inside the loop of the flexible belt (6) such that an underpressure can be generated that draws the paper web (W) against the flexible belt (6). The at least one blow box (7, 8, 9) has at least one nozzle (10) through which air is blown out of the at least one blow box (7, 8, 9) and the nozzle is shaped as a slot. According to the invention, the at least one blow (7,8, 9) box faces the flexible belt (6) with an outer surface (11) which is convexly curved such that dust which has been sucked through the flexible belt (6) and lands on the at least one blow box (7, 8, 9) is helped by gravity to glide along the outer surface (11) of the blow box (7, 8, 9) and fall of the blow box (7, 8, 9).

11 Claims, 8 Drawing Sheets

(51) Int. Cl.
*B08B 5/04* (2006.01)
*B65H 23/24* (2006.01)

(52) U.S. Cl.
CPC ..... *B65H 2301/44322* (2013.01); *B65H 2301/44336* (2013.01); *B65H 2301/44735* (2013.01); *B65H 2404/256* (2013.01); *B65H 2404/281* (2013.01); *B65H 2406/122* (2013.01); *B65H 2406/3124* (2013.01); *B65H 2407/51* (2013.01); *B65H 2801/84* (2013.01)

(58) Field of Classification Search
USPC ..... 162/283; 242/535.4
See application file for complete search history.

(56) References Cited

U.S. PATENT DOCUMENTS

| | | | | |
|---|---|---|---|---|
| 6,247,247 | B1 | 6/2001 | Yomaa et al. | |
| 6,454,901 | B1 | 9/2002 | Sekiya et al. | |
| 6,574,884 | B1 | 6/2003 | Jokinen | |
| 6,695,245 | B1 | 2/2004 | Schultz et al. | |
| 6,698,681 | B1 | 3/2004 | Guy et al. | |
| 7,398,943 | B2 * | 7/2008 | Horneck | B65H 18/26 242/534 |
| 9,393,593 | B2 | 7/2016 | Niemi et al. | |
| 9,511,968 | B2 * | 12/2016 | Malmqvist | B65H 19/265 |
| 2004/0244218 | A1 | 12/2004 | Leimu | |
| 2005/0077171 | A1 | 4/2005 | Hagemann et al. | |
| 2005/0230447 | A1 | 10/2005 | Koljonen et al. | |
| 2006/0289692 | A1 | 12/2006 | Horneck et al. | |
| 2010/0078140 | A1 | 4/2010 | Hughes | |
| 2016/0016745 | A1 | 1/2016 | Malmqvist et al. | |
| 2016/0031667 | A1 * | 2/2016 | Klerelid | B65H 20/06 162/111 |
| 2016/0185548 | A1 * | 6/2016 | Malmqvist | B65H 19/265 242/526.3 |

FOREIGN PATENT DOCUMENTS

| | | | |
|---|---|---|---|
| CN | 1081485 | A | 2/1994 |
| CN | 1322165 | A | 11/2001 |
| CN | 1582356 | A | 2/2005 |
| CN | 1673057 | A | 9/2005 |
| CN | 102312389 | A | 1/2012 |
| CN | 102817275 | A | 12/2012 |
| CN | 102905798 | A | 1/2013 |
| EP | 2233418 | A2 | 9/2010 |
| JP | H03-195655 | A | 8/1991 |
| SE | 1350395 | A1 | 9/2014 |
| WO | WO 1999/001363 | A1 | 1/1999 |
| WO | WO 2003/040468 | A1 | 5/2003 |

OTHER PUBLICATIONS

State Intellectual Property Office of the P.R.C., Third Office Action for Application No. 201480061672.1, dated Jun. 1, 2017, 20 pages, China.

International Searching Authority, International Search Report and Written Opinion for Application No. PCT/SE2014/051395, dated Apr. 17, 2015, 10 pages, Swedish Patent and Registration Office, Sweden.

State Intellectual Property Office of the P.R.C., First Office Action for Application No. 201480061672.1, dated Nov. 16, 2016, 18 pages, China. Yes.

European Patent Office, Extended European Search Report for Application No. 14878003.4, dated Aug. 31, 2017, 5 pages, Germany.

* cited by examiner

REEL-UP FOR RECEIVING AND WINDING INTO A ROLL A PAPER WEB THAT ARRIVES FROM A DRYING CYLINDER IN A PAPER MAKING MACHINE AND A PAPER MAKING MACHINE USING A REEL-UP

CROSS REFERENCE TO RELATED APPLICATIONS

This application is a National Stage Application, filed under 35 U.S.C. 371, of International Application No. PCT/SE2014/051395, filed Nov. 21, 2014, which claims priority to Swedish Application No. 1450011-0, filed Jan. 9, 2014, the contents of which are hereby incorporated by reference in their entirety.

BACKGROUND

Related Field

The present invention relates to a reel-up for receiving and winding into a roll a paper web that arrives from a drying cylinder in a paper making machine. The invention also relates to a paper making machine using a reel-up.

Description of Related Art

In the dry end of a paper making machine, the dried paper web is wound on reel spools into parent rolls in a reel-up. In U.S. Pat. No. 5,901,918, a reel-up is disclosed in which the reel spool is engaged by an endless flexible member such as a transfer belt. The paper web is transferred from the endless flexible member to the parent roll as the parent roll is urged against the paper web as the paper web is supported by the endless flexible member. As the paper web travels on the endless flexible member, it is desirable that it adheres to the endless flexible member. It has been suggested in Swedish patent application No. 1350395-8 that the endless flexible member in such a reel-up may be an air permeable belt and that at least one blow box may be placed inside the loop of the air permeable belt in order to generate an underpressure that draws the paper web against the belt. The use of an air permeable belt in combination with a blow box does contribute to a more reliable operation. However, the inventors have found that the operation of the blow box in this position is not always reliable. Therefore, it is an object of the invention to provide an improved reel-up with an air permeable belt and a blow box in which the operation of the blow box is more reliable.

BRIEF SUMMARY

The invention relates to a reel-up for receiving and winding into a roll a paper web that arrives from a drying cylinder in a paper making machine. The inventive reel-up comprises a rotatably mounted reel spool onto which a paper web can be wound to create a paper roll of increasing diameter and an endless flexible belt mounted for rotation along a predetermined path of travel such that the flexible belt forms a loop. The flexible belt is positioned adjacent to the reel spool to engage the paper web against the reel spool during winding such that the flexible belt is deflected from the predetermined path of travel when the paper roll starts to build up on the reel spool. The flexible belt is air permeable and at least one blow box is arranged inside the loop of the flexible belt such that an underpressure can be generated that draws the paper web against the flexible belt. The blow box has at least one nozzle through which air is blown out of the blow box and which nozzle is shaped as a slot. According to the invention, the at least one blow box faces the flexible belt with an outer surface which is convexly curved such that dust which has been sucked through the flexible belt and lands on the blow box is helped by gravity to glide along the outer surface of the blow box and fall of the blow box.

In embodiments of the invention, the nozzle is arranged in the blow box such that it extends in a cross machine direction and is shaped such that, where the air leaves the nozzle, the air is blown tangentially along the outer surface of the blow box such that the air is caused by the Coanda effect to follow the outer surface of the blow box.

The at least one blow box may optionally have a circular cylindrical cross section although other shapes are also conceivable.

In embodiments of the invention, the reel-up comprises two blow boxes within the loop of the flexible belt and each of the blow boxes faces the flexible belt with an outer surface that is convexly curved. Embodiments of the invention are also conceivable in which the reel-up comprises more than two blow boxes within the loop of the flexible belt. For example, embodiments with three, four or five blow boxes within the loop of the flexible belt are conceivable.

Preferably, the flexible belt is guided in its path by at least a first guide roll, a second guide roll, a third guide roll and optionally also a fourth guide roll. Embodiments are also possible where more than four guide rolls for the flexible belt are used. For example, there could be five, six or seven or even more guide rolls. The guide rolls may all be located inside the loop of the flexible belt but some of the guide rolls may also be located outside the loop of the flexible belt but at least four guide rolls should be located inside the loop of the flexible belt. In embodiments of the invention, a first blow box may be arranged after the first guide roll in the machine direction and in this first blow box, the nozzle is arranged such that air blown out of the blow box exits the nozzle in a direction that substantially coincides with the machine direction. A second blow box is arranged before the second guide roll in the machine direction and in the second blow box, the nozzle is arranged such that air blown out of the blow box exits the nozzle in a direction which is against the machine direction.

In embodiments of the invention, each nozzle has a height in the range of 0.1 mm-5 mm and a width in the range of 0.3 m-10 m, preferably a width in the range of 0.5 m-10 m.

In advantageous embodiments of the invention, the blow box or blow boxes is/are placed at a distance of 1 mm-50 mm from the permeable belt, preferably at a distance of 5 mm-30 mm from the permeable belt and even more preferred at a distance of 15 mm-25 mm.

The blow box (or blow boxes) may optionally be supplied with pressurized air through a plurality of air supply conduits that are distributed in the cross machine direction for each blow box.

In embodiments of the invention, the flexible belt is an air permeable woven fabric with a plurality of warp yarns and a plurality of weft yarns interwoven with the plurality of warp yarns and wherein at least some of the yarns are electrically conductive and preferably at least some of the weft yarns are electrically conductive.

The reel-up may optionally further comprises a deflection sensor mounted adjacent to the flexible belt and arranged to measure the amount of deflection of the flexible belt from the predetermined path of travel. In such embodiments, there would normally also be an actuator for positioning the reel spool and the flexible belt relative to each other to vary the amount of deflection of the flexible belt and a controller connected to the deflection sensor and the actuator for controlling the amount of deflection of the flexible belt as the paper roll increases in diameter.

The invention also relates to a paper making machine for making tissue paper and which comprises a Yankee drying cylinder and a doctor blade arranged to crepe a paper web from the surface of the Yankee drying cylinder, and wherein, downstream of the Yankee drying cylinder, the paper making machine further comprises a reel-up according to the invention.

BRIEF DESCRIPTION OF THE FIGURES

FIG. 1 is a schematic side view of a part of a reel-up of the type that the present invention relates to.

DETAILED DESCRIPTION OF VARIOUS EMBODIMENTS

Figure 1:
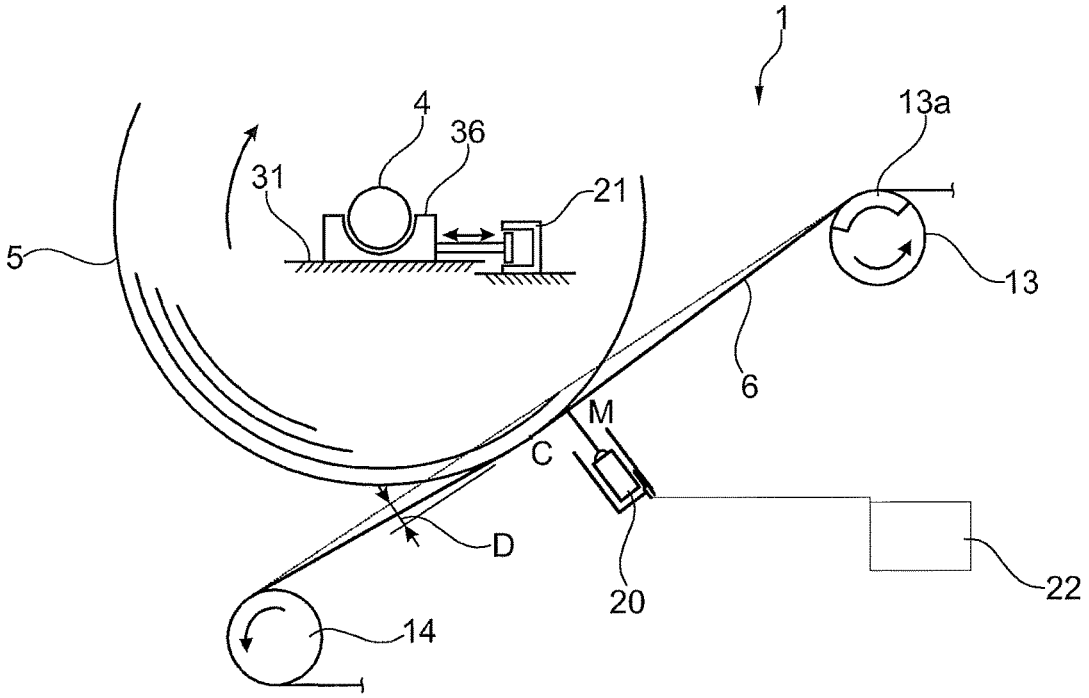
Figure 2:
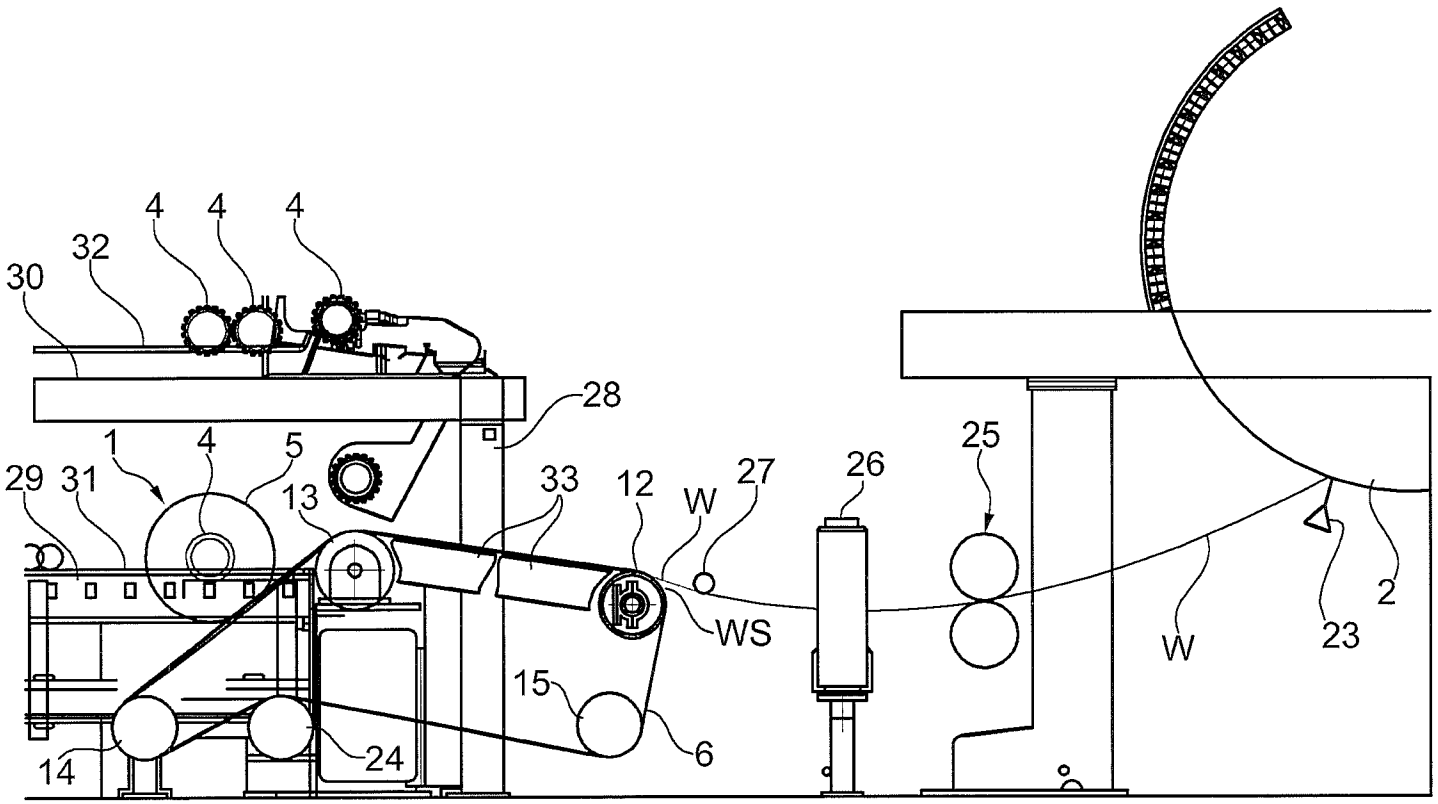
FIG. 2 is a side view of a reel-up placed in the dry end of a paper making machine.

With reference to FIG. 1 and to FIG. 2, the reel-up 1 of the present invention is designed to receive and wind into a roll 5 a paper web W that arrives from a drying cylinder 2 in a paper making machine. The paper web W is in particular a tissue paper web. The reel-up according to the present invention is of the type disclosed in U.S. Pat. No. 5,901,918 and reference is made to that patent for a detailed explanation of how such a reel-up may be designed. As can be seen in FIG. 1, the reel-up 1 comprises a rotatably mounted reel spool 4 onto which a paper web W can be wound to create a paper roll 5 of increasing diameter and an endless flexible belt 6 mounted for rotation along a predetermined path of travel such that the flexible belt 6 forms a loop. The flexible belt 6 is positioned adjacent to the reel spool 4 to engage the paper web W against the reel spool 4 during winding such that the flexible belt 6 is deflected from the predetermined path of travel when the paper roll 5 starts to build up on the reel spool 4. Of course, once the web has started to become wound on the reel spool 4, new paper web that arrives will be engaged against the reel spool 4 through the paper roll 5 that is being formed on the reel spool 4. In the context of this application and any patent granted on this patent application, the expression "engage the paper web against the reel spool" should thus be understood as including the case where the web that arrives to the nip point C is engaged by the flexible belt against the paper roll 5 that is wound on the reel spool 4. The flexible belt 6 is air permeable. With reference to FIG. 2, blow boxes 33 are placed within the loop of the flexible belt 6. The blow boxes 33 create an underpressure that draws the web W against the flexible belt 6 such that the web W is held on the flexible belt 6. The flexible belt 6 runs in a loop supported by four guide rolls 12, 13, 14, 15 that are located inside the loop of the flexible belt 6. Optionally, an outer roll 24 may be used which is movable and can be used to regulate tension in the flexible belt 6. It should be understood that embodiments are possible in which only three internal guide rolls are used. With reference to FIG. 2, it can be seen how the web W is creped from the surface of a Yankee drying cylinder by a doctor blade 23 and passed on to the reel-up 1. On its way from the Yankee drying cylinder 2 to the reel-up 1, the tissue paper web W may optionally pass through a calender 25 and it may optionally also pass through a measuring device 26 measures such properties as, for example, basis weight. In FIG. 2, the web W passes in a substantially open draw to the reel-up 1 and is supported only by a single upper guide roll 27. Embodiments are possible in which the tissue paper web W is supported over a part or over the whole of the distance from the Yankee drying cylinder 2 to the reel-up 1. In FIG. 2, it can be seen how the reel-up may be connected to a stand with vertical pillars 28 that carry lower and upper support beams 29, 30. On the upper support beam 30, there may be a rail 32 on which new reel spools 4 are supported. When a roll 5 is completed, a new reel spool 4 can be taken from the upper rail 32. The lower support beam 29 may have a rail 31.

With reference to FIG. 1, the reel-up 1 may further comprise a deflection sensor 20 mounted adjacent to the flexible belt 6 and being arranged to measure the amount of deflection D of the flexible belt 6 from the predetermined path of travel as described in U.S. Pat. No. 5,901,918. An actuator 21 is arranged for positioning the reel spool 4 and the flexible belt 6 relative to each other to vary the amount of deflection of the flexible belt 6 and a controller 22 is connected to the deflection sensor 20 and the actuator 21 for controlling the amount of deflection D of the flexible belt 6 as the paper roll 5 increases in diameter. When the deflection sensor 20 sends a signal to the controller 22 that the deflection D of the flexible belt 6 has become larger than a set value for the deflection D, the controller 22 causes the actuator 21 to act on a carriage 36 in which the reel spool 4 is supported such that the reel spool 4 and the paper roll 5 moves along the rail 31, In this way, the deflection D can be kept within predetermined limits such that nip pressure in the contact point C also remains within the right limits. It should be noted that the point M where measurement of the deflection D is made need not coincide with the point C where the deflection D reaches its largest value.

The blow boxes 33 in the embodiment of FIG. 2 improve the operation of the reel-up by contributing to make the tissue paper web W adhere to the flexible belt. However, the inventors have discovered that when a blow box is used for such reel-ups as described above, there is a new problem. Blow boxes as such are conventional and used in many parts of a paper making machine. However, in the area after a Yankee drying cylinder, the tissue paper web W is very dry which means that it is more likely to emit dust and this is especially the case if it has been creped from the drying cylinder 2. When the tissue paper web W carries large amounts of dust, the underpressure created by the blow box 33 will not only suck the paper web W against the flexible belt 6, it will also suck considerable amounts of dust particles through the flexible belt 6. When large amounts of dust particles and/or pieces of broke land on the blow box or blow boxes 33, dust and/or broke may accumulate on the surface of the blow box or blow boxes 33 and clog the nozzle openings of the blow box such that the blow box 33 does not function properly. The accumulation of dust and/or broke may also cause wear on the flexible belt 6.

The inventors have found that this problem can be eliminated or at least substantially reduced by giving the blow box or blow boxes a different design.

Figure 3:
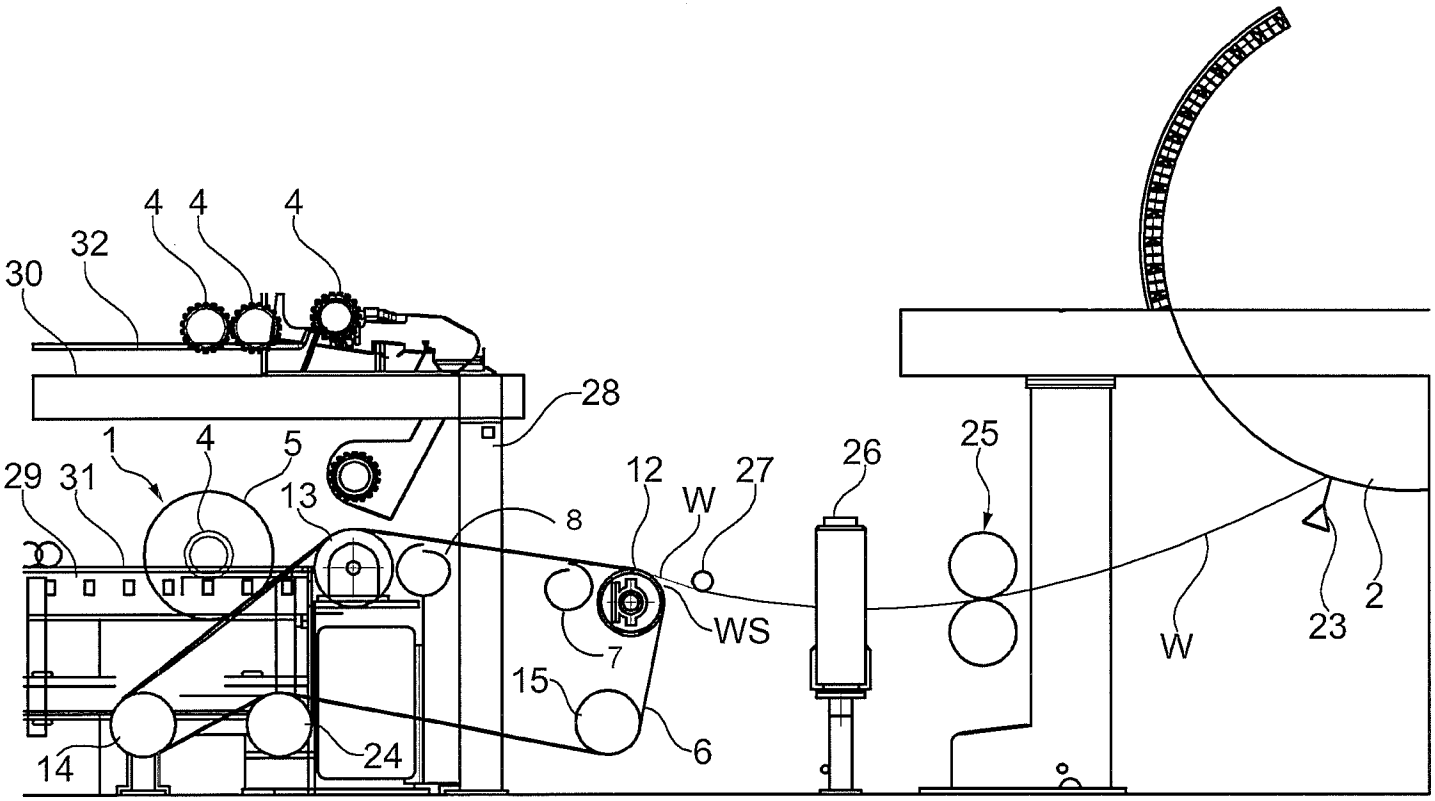
FIG. 3 is a side view corresponding to FIG. 2 but which has been modified to incorporate such blow boxes as are used in the present invention.

FIG. 3 shows a reel-up 1 in a paper machine. This reel-up is substantially similar to the reel-up of FIG. 2 and operates in the way explained with reference to FIG. 1. However it has blow boxes 7, 8 that are designed to eliminate or reduce the problem of dust that comes through the flexible belt 6.

Figure 4A:
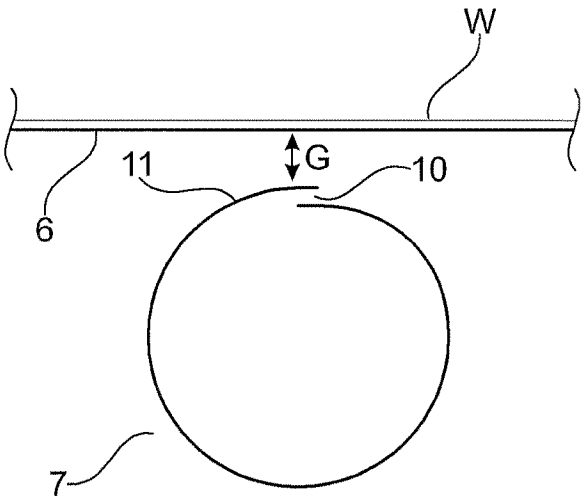
FIG. 4*a*, FIG. 4*b* and FIG. 4*c* show cross sectional side views of a component of a reel-up according to the present invention.
Figure 4B:
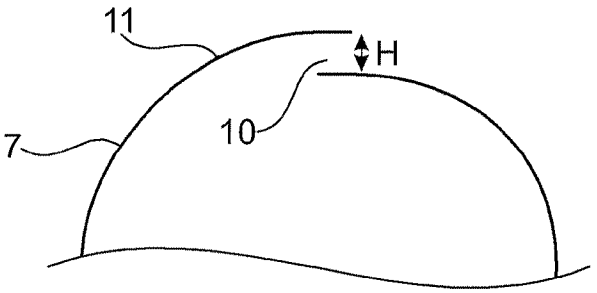
Figure 4C:
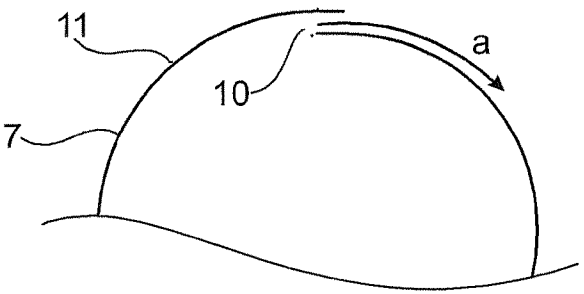

With reference to FIG. 3 and FIGS. 4*a*-4*c*, there is at least one blow box 7, 8, that is arranged inside the loop of the flexible belt 6 such that an underpressure can be generated that draws the paper web W against the flexible belt 6. As can be seen in FIGS. 4*a*-4*c*, the at least one blow box 7, 8, 9 has at least one nozzle 10 through which air is blown out of the at least one blow box 7, 8. The nozzle 10 is shaped as a slot. According to the invention, the at least one blow box 7, 8 faces the flexible belt 6 with an outer surface 11 which is convexly curved such that dust which has been sucked through the flexible belt 6 and lands on the at least one blow box 7, 8 is helped by gravity to glide along the outer surface 11 of the blow box 7, 8 and fall of the blow box 7, 8. In other words, the outer surface 11 is so shaped and so arranged in relation to a horizontal plane and to the belt 6 that dust coming through the flexible belt 6 will glide along the outer surface 11 and fall off the blow box.

In the embodiment of FIG. 3 and FIGS. 4*a*-4*c*, the at least one blow box 7, 8, 9 has a circular cylindrical cross section but other shapes are also conceivable. The circular cylindrical shape functions well and is easy to manufacture but the most important thing is that dust particles coming through the flexible belt 6 should not land on a flat surface where they can accumulate.

The nozzle 10 is arranged in the blow box 7, 8 such that it extends in a cross machine direction. Preferably, it is shaped such that, where the air leaves the nozzle 10, the air is blown tangentially along the outer surface 11 of the blow box 7, 8, 9 such that the air is caused by the Coanda effect to follow the outer surface 11 of the blow box 7, 8. In this way, dust particles can be removed more efficiently. As can be seen in FIG. 4*c*, the air blown out of the nozzle 10 follows the path of the arrow a along the outer surface 11 of the blow box 7. To achieve this effect, it is sufficient that the air leaves the nozzle 10 in a direction that is substantially tangential to the outer surface 11 of the blow box 7 at that point where the air is blown out of the nozzle 10.

Each nozzle 10 preferably has a height H in the range of 0.1 mm-5 mm and a width in the range of 0.3 m-10 m, preferably a width in the range of 0.5 m-10 m.

The blow box or blow boxes 7, 8, 9 should be kept close to the flexible belt 6 such that the blow box or blow boxes can create an underpressure that acts through the belt 6. Preferably, the blow box or blow boxes 7, 8 is/are placed at a distance G of 1 mm-50 mm from the flexible belt band preferably at a distance of 5 mm-30 mm from the flexible belt 6. Even more preferred, the distance G between the blow box or blow boxes 7, 8 and the flexible belt should be in the range of 15 mm-25 mm. It should be understood that, in FIG. 4*a*, the distance G is the smallest distance between the blow box 7 and the flexible belt 6. In preferred embodiments of the invention, the nozzle 10 is placed at that point where the distance between the blow box 7 and the flexible belt is smallest.

Figure 5:
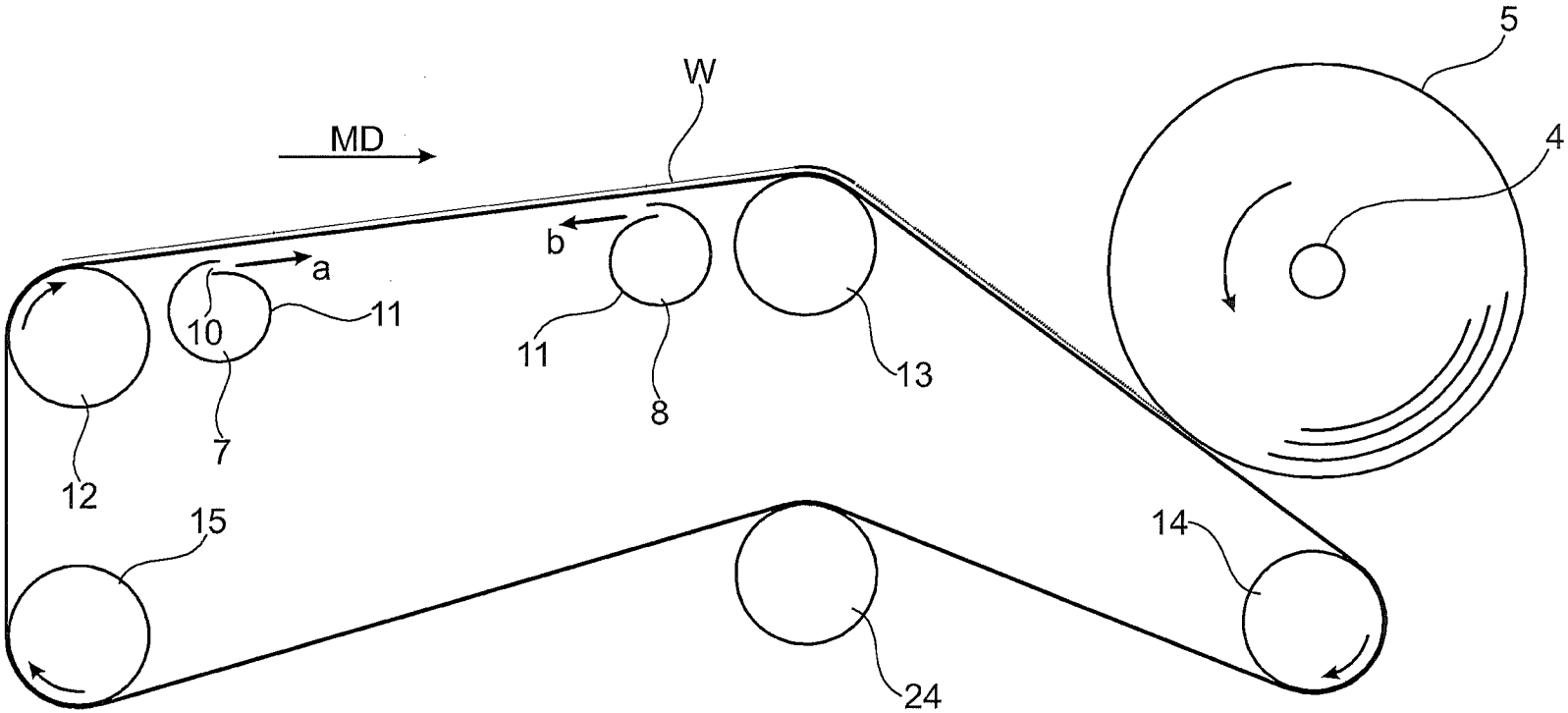
FIG. 5 is a cross sectional view showing an embodiment with two blow boxes.

With reference to FIG. 5, the reel-up 1 may optionally comprise two blow boxes 7, 8 within the loop of the flexible belt and wherein each of the blow boxes 7, 8 faces the flexible belt 6 with an outer surface 11 that is convexly curved.

As can be seen in FIG. 5, the flexible belt 6 is guided in its path by at least a first guide roll 12, a second guide roll 13, and a third guide roll 14. Optionally, there may also be a fourth guide roll 15. The first blow box 7 is arranged after the first guide roll 12 in the machine direction MD and the nozzle 10 of the first blow box 7 is facing in such a direction that air blown out of the first blow box 7 exits the nozzle 10 in a direction "a" that substantially coincides with the machine direction MD (see the arrow "a" in FIG. 5). The second blow box 8 is arranged before the second guide roll 13 in the machine direction MD and in the second blow box 8, the nozzle 10 is arranged such that air blown out of the second blow box 8 exits the nozzle 10 in a direction "b" which is against the machine direction (i.e. opposite to the machine direction MD, see the arrow "b" in FIG. 5). The reason for this arrangement is the following. In the space between the blow boxes 7, 8 and their respective adjacent guide roll 12, 13, it may easily happen that air is accumulated in such a way that is contrary to the objective of creating an underpressure. By blowing in the opposite direction, this can be counteracted.

Figure 6:
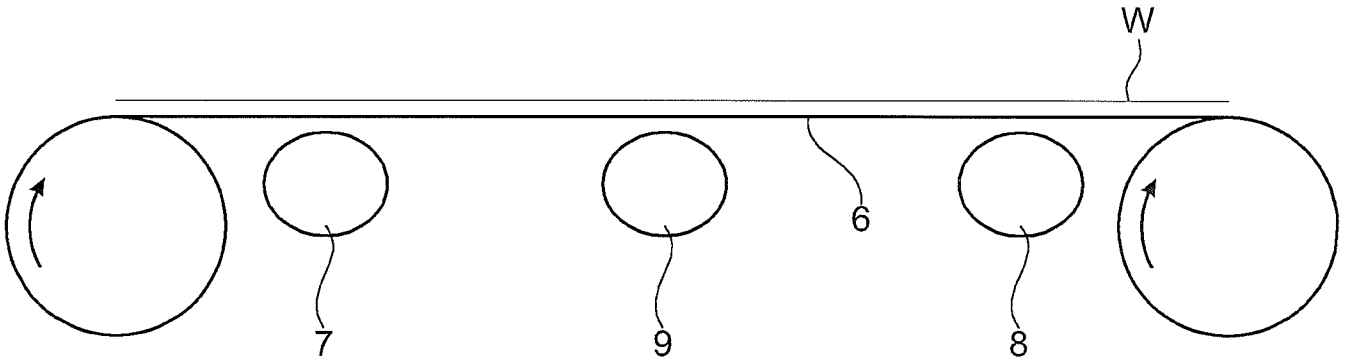
FIG. 6 is a cross sectional view showing an embodiment with three blow boxes.

With reference to FIG. 6, embodiments with three blow boxes with a convex outer surface are possible. It should be understood that there could also be more than three such blow boxes. For example, there could be four, five, six or even more such blow boxes. It should be understood that each blow box 7, 8, 9 can be arranged (oriented) such that it blow air either in the machine direction or against the machine direction.

Figure 8:
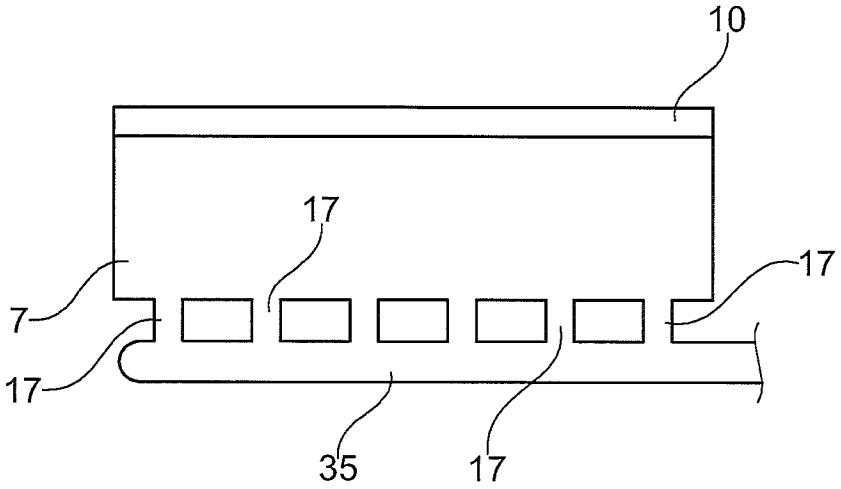
FIG. 8 is a front view of a part of the blow box of FIG. 7.
Figure 7:
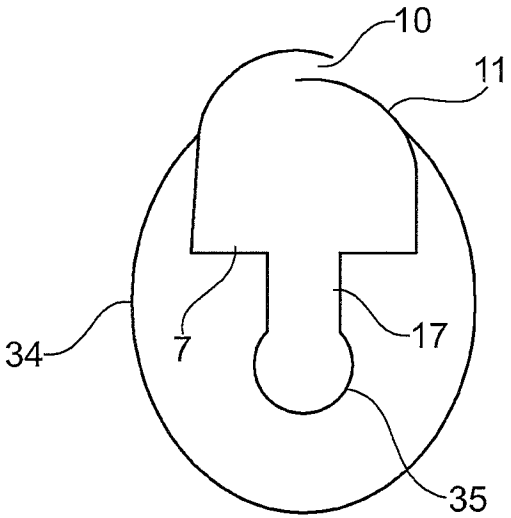
FIG. 7 is a cross sectional side view of an alternative embodiment of a blow box.

With reference to FIG. 7 and FIG. 8, another embodiment shall now be explained. The blow box 7 of FIG. 7 does not have a circular cylindrical shape but still has a convex outer surface facing the flexible belt 6. The at least one blow box 7, 8, 9 is supplied with pressurized air through a plurality of air supply conduits 17 that are distributed in the cross machine direction. A main air supply conduit 35 extends in the cross machine direction and a plurality of air supply conduits 17 extend from the main air supply conduit 35 into the blow box 7 such that the blow box 7 is supplied with pressurized air. The blow box 7 may optionally be partially covered by an outer shell 34.

Figure 9:
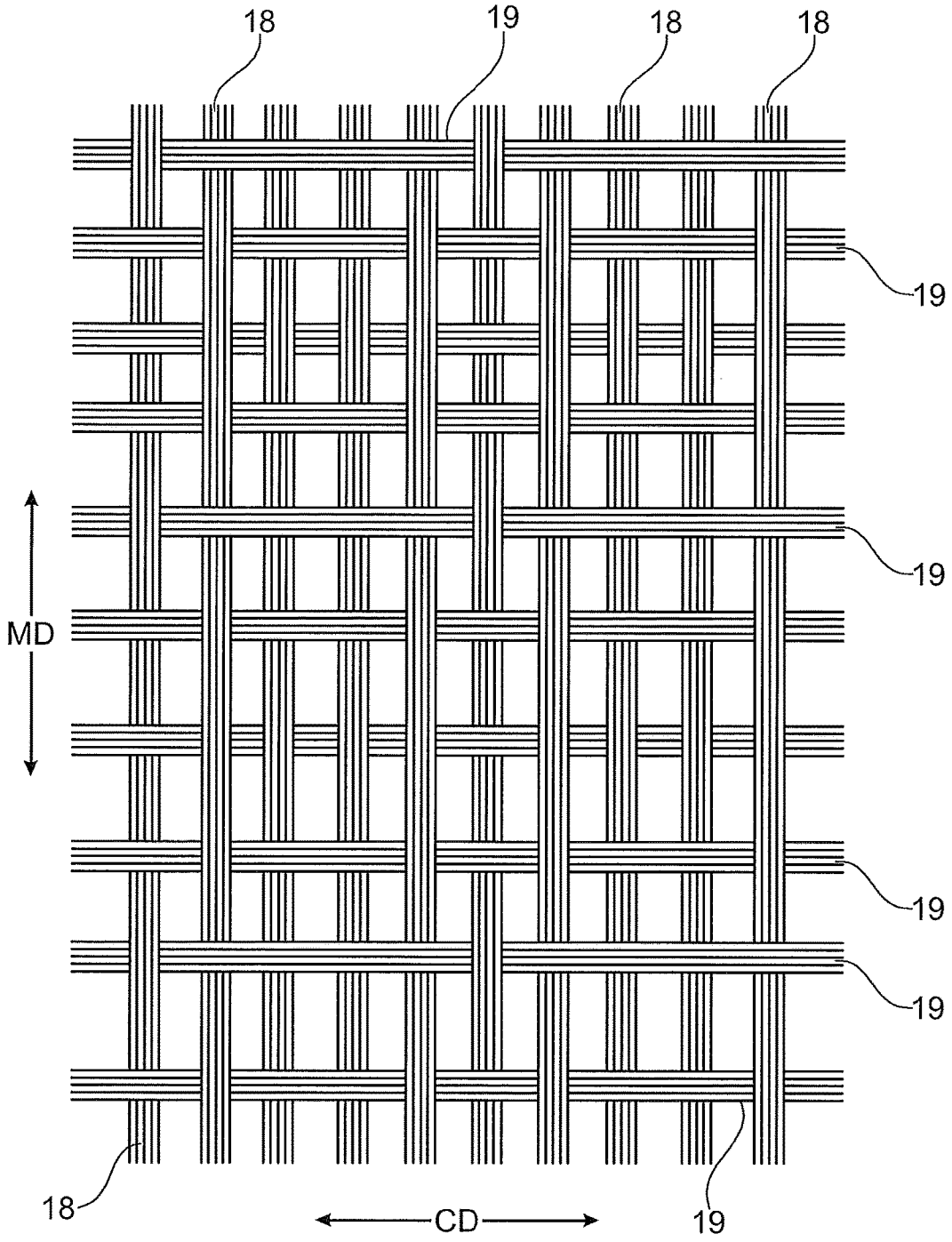
FIG. 9 shows a possible embodiment of a flexible belt that may be used in the present invention.

A possible embodiment of the flexible belt is illustrated in FIG. 9. The flexible belt 6 of FIG. 9 is an air permeable woven fabric with a plurality of warp yarns 18 and a plurality of weft yarns 19 interwoven with the plurality of warp yarns 18 and at least some of the yarns 18, 19 are electrically conductive and preferably at least some of the weft yarns 19 are electrically conductive. If some of the yarns 18, 19 are electrically conductive, this may contribute to dissipate any static electricity which would otherwise disturb the operation of the reel-up 1.

With reference to FIG. 3, it should be understood that the invention also relates to a paper making machine 3 for making tissue paper and which comprises a Yankee drying cylinder 2 and a doctor blade 23 arranged to crepe a paper web W from the surface of the Yankee drying cylinder 2, and wherein, downstream of the Yankee drying cylinder 2, the paper making machine 3 further comprises the inventive reel-up with one or several blow boxes having a convex surface facing the flexible belt 6.

The invention claimed is:

1. A reel-up (1) for receiving and winding into a roll (5) a paper web (W) that arrives from a drying cylinder (2) in a paper making machine, the reel-up (1) comprising:

a rotatably mounted reel spool (4) onto which a paper web (W) is wound to create a paper roll (5) of increasing diameter; and an endless flexible belt (6) mounted for rotation along a predetermined path of travel such that the flexible belt (6) forms a loop, the flexible belt (6) being positioned adjacent to the reel spool (4) to engage the paper web (W) against the reel spool (4) during winding such that the flexible belt (6) is deflected from the predetermined path of travel when the paper roll (5) starts to build up on the reel spool (4), wherein:

the flexible belt (6) is air permeable and at least two blow boxes (7, 8, 9) are arranged inside the loop of the flexible belt (6) such that an underpressure is generated that draws the paper web (W) against the flexible belt (6), the at least two blow boxes (7, 8, 9) each having at least one nozzle (10) shaped as a slot, air is blown out of the at least two blow boxes (7, 8, 9) through the at least one nozzle (10), the at least two blow boxes (7, 8, 9) each have an outer surface (11) that faces the flexible belt (6) and that is convexly curved such that dust which has been sucked through the flexible belt (6) and lands on the at least two blow boxes (7, 8, 9) is helped by gravity to glide along the outer surface (11) of each of the at least two blow boxes (7, 8, 9) and fall off each of the at least two blow boxes (7, 8, 9);

the flexible belt (6) is guided in its path by at least a first guide roll (12), a second guide roll (13), and a third guide roll (14), a first of the at least two blow boxes (7) is arranged after the first guide roll (12) in the machine direction, such that the nozzle (10) of the first of the at least two blow boxes (7) is configured such that the air blown out of the first of the at least two blow boxes (7) exits the at least one nozzle (10) of the first of the at least two blow boxes (7) in a direction that substantially coincides with the machine direction, a second of the at least two blow boxes (9) is arranged before the second guide roll (13) in the machine direction, such that the nozzle (10) of the second of the at least two blow boxes (9) is configured such that the air blown out of the second of the at least two blow boxes (9) exits the at least one nozzle (10) of the second of the at least two blow boxes in a direction opposite the machine direction, and the nozzle (10) of each of first and the second of the at least two blow boxes (7, 9) is arranged to blow the air blown out of each of the first and the second of the at least two blow boxes (7, 9) into a space between the first and the second of the at least two blow boxes (7, 9).

2. The reel-up (1) according to claim 1, wherein the at least one nozzle (10) of each of the at least two blow boxes (7, 8, 9) is arranged such that the at least one nozzle (10) extends in a cross machine direction and is shaped such that, where the air leaves the nozzle (10), the air is blown tangentially along the outer surface (11) of each of the at least two blow boxes (7, 8, 9) such that the air is caused by the Coanda effect to follow the outer surface (11) of each of the at least two blow boxes (7, 8, 9).

3. The reel-up (1) according to claim 1, wherein the at least two blow boxes (7, 8, 9) each have a circular cylindrical cross section.

4. The reel-up (1) according to claim 1, wherein each nozzle (10) has a height in the range of 0.1 mm-5 mm and a width in the range of 0.5 m-10 m.

5. The reel-up (1) according to claim 1, wherein each of the at least two blow boxes (7, 8, 9) is placed at a distance of 1 mm-50 mm from the flexible belt (6).

6. The reel-up (1) according to claim 1, wherein each of the at least two blow boxes (7, 8, 9) is placed at a distance of 5 mm-30 mm from the flexible belt (6).

7. The reel-up (1) according to claim 1, wherein each of the at least two blow boxes (7, 8, 9) is supplied with pressurized air through a plurality of air supply conduits (16) that are distributed in the cross machine direction.

8. The reel-up according to claim 1, wherein the flexible belt (6) is an air permeable woven fabric with a plurality of warp yarns (17) and a plurality of weft yarns (18) interwoven with the plurality of warp yarns (17) and wherein at least some of the yarns (17, 18) are electrically conductive.

9. The reel-up according to claim 1, wherein the flexible belt (6) is an air permeable woven fabric with a plurality of warp yarns (17) and a plurality of weft yarns (18) interwoven with the plurality of warp yarns (17) and wherein at least some of the weft yarns (18) are electrically conductive.

10. The reel-up (1) according to claim 1, wherein the reel-up (1) further comprises:

a deflection sensor (20) mounted adjacent to the flexible belt (6) and being arranged to measure the amount of deflection (D) of the flexible belt (6) from the predetermined path of travel;

an actuator (21) for positioning the reel spool (4) and the flexible belt (6) relative to each other to vary the amount of deflection of the flexible belt (6); and a controller (22) connected to the deflection sensor (20) and the actuator (21) for controlling the amount of deflection (D) of the flexible belt (6) as the paper roll (5) increases in diameter.

11. A paper making machine (3) for making tissue paper and which comprises a Yankee drying cylinder (2) and a doctor blade (23) arranged to crepe a paper web (W) from the surface of the Yankee drying cylinder (2), and wherein, downstream of the Yankee drying cylinder (2), the paper making machine (3) further comprises the reel-up (1) according to claim 1.

* * * * *